US005333597A

United States Patent [19]

Kirkpatrick et al.

[11] Patent Number: 5,333,597

[45] Date of Patent: Aug. 2, 1994

[54] ABATEMENT MEMBER AND METHOD FOR INHIBITING FORMATION OF OXIDES OF NITROGEN

[75] Inventors: Michael E. Kirkpatrick; Paul M. Haydock, both of West Lafayette, Ind.

[73] Assignee: Consolidated Industries Corp., Lafayette, Ind.

[21] Appl. No.: 55,977

[22] Filed: Apr. 30, 1993

[51] Int. Cl.[5] ..... F24H 3/02

[52] U.S. Cl. ..... 126/110 R; 126/116 R; 138/38; 165/109.1; 431/171; 431/347

[58] Field of Search ..... 126/99 R, 99 A, 116 R, 126/110 R, 91 A, 92 AC, 91 R; 431/347, 171, 2, 326, 353; 165/109.1; 138/38

[56] References Cited

U.S. PATENT DOCUMENTS

| | | | |
|---|---|---|---|
| 1,632,888 | 6/1927 | Davis et al. | 138/38 |
| 2,591,398 | 4/1952 | Brock | 126/91 A |
| 2,655,944 | 10/1953 | Proehl | 138/38 |
| 3,185,143 | 5/1965 | Wilson, Sr. | 126/91 A |
| 3,187,798 | 6/1965 | Pokorny | 126/91 A |
| 3,359,964 | 12/1967 | Wilson, Sr. | 126/91 A |
| 3,726,633 | 4/1973 | Vasilakis et al. | 431/328 |
| 4,044,796 | 8/1977 | Smick | 138/38 |
| 4,284,402 | 8/1981 | Sheets et al. | 431/171 |
| 4,375,214 | 3/1983 | Wysong | 126/92 AC |
| 4,616,994 | 10/1986 | Tomlinson | 431/347 |
| 4,727,907 | 3/1988 | Duncan | 138/38 |
| 4,776,320 | 10/1988 | Ripka et al. | 431/347 |
| 4,904,179 | 2/1990 | Drago et al. | 126/110 |
| 4,945,890 | 8/1990 | Ripka | 126/110 R |
| 5,146,910 | 9/1992 | Grahl | 126/110 R |
| 5,174,744 | 12/1992 | Singh | 431/347 |

FOREIGN PATENT DOCUMENTS

| | | |
|---|---|---|
| 806991 | 6/1951 | Fed. Rep. of Germany . |
| 2413381 | 2/1975 | Fed. Rep. of Germany . |
| 12582 | of 1904 | United Kingdom . |
| 2059042 | 4/1981 | United Kingdom . |

*Primary Examiner*—James C. Yeung
*Attorney, Agent, or Firm*—Victor E. Libert; Frederick A. Spaeth

[57] ABSTRACT

An abatement member for inhibiting formation of oxides of nitrogen in a gas-fired furnace by controlling peak flame temperatures and residence times at the peak flame temperatures is described. The combustion system has at least one heat exchanger conduit having a flow path therethrough and at least one gas burner for burning fuel to produce a combustion flame. The abatement member has a porous refractory body portion having at least one section which is disposed transversely to the direction of flow of gases through the conduit. In one embodiment, the abatement member is a metallic screen having a serpentine shape and positioned within the fire tube. The combustion flame is directed toward and into the inlet of a fire tube and through the screen whereby the screen absorbs thermal energy from the combustion flame at a rate which limits peak flame temperatures to levels which inhibit formation of oxides of nitrogen.

6 Claims, 2 Drawing Sheets

ABATEMENT MEMBER AND METHOD FOR INHIBITING FORMATION OF OXIDES OF NITROGEN

BACKGROUND OF THE INVENTION

1. Field of the Invention

This invention relates to the reduction of pollutants produced by gas-fired combustion systems, and more particularly to a method amd apparatus for inhibiting the formation of oxides of nitrogen ($NO_x$) in gas-fired forced air furnaces.

2. Background and Related Art

The combustion process for gas-fired furnaces generates gaseous combustion products, including $NO_x$, which are vented to the atmosphere as flue gases. Since $NO_x$ is a pollutant, it is desirable to limit the emission of $NO_x$ into the atmosphere and toward this end some jurisdictions require that combustion systems meet strict $NO_x$ emission standards. Several techniques have been used to inhibit the formation of pollutants in combustion systems. For example, U.S. Pat. No. 3,726,633, issued Apr. 10, 1973 to A.D. Vasilakis et al, teaches that pollutants from a liquid-fired burner can be reduced by more completely combusting the fuel. In the system of the Patent, air and fuel are supplied to a burner and the flame is directed into a wire mesh cage formed from a cylindrical radiant wire mesh screen bounded at the ends by ceramic plates, one of which has an aperture through which the flame is introduced into the cage. The other end plate of the cylinder is a plain disc of castable firebrick. The screen is described as being made of Inconel, Nichrome 5, silicon carbide fibers or other high-temperature oxidation resistant material (see column 1, lines 61–65). The cylindrical screen is heated by radiation from the combustion flame and by convection from the combustion gases falling through the screen. The screen loses heat to the ambient volume principally by radiation and maintains an equilibrium temperature lower than that at which $NO_x$ is formed. Complete combustion with minimum excess air and low pressure drop is stated to be achieved, resulting in operation at high thermal efficiency with minimal pollutant production.

U.S. Pat. No. 4,776,320, issued Oct. 11, 1988 to Ripka et al, is directed to a device for use in a combustion system to inhibit formation of oxides of nitrogen. The device is stated to comprise a piece of material positioned relative to the combustion flame produced by a burner to temper the combustion by absorbing thermal energy from the combustion flame. The device, called a flame radiator structure, is a perforated tubular structure having a generally rectangular cross section. The device is shown in FIG. 2, noted number 11. Also, an alternate design for the device is stated to be a stainless steel cylindrical screen shown in FIG. 5. It is made of stainless steel material 30 having mounting flanges 31 as shown in FIG. 5. It is stated that a desirable location for the flame radiator structure relative to the combustion flame produced by a two-zone combustion-type burner is at the periphery of the combustion flame as shown in FIG. 4 where the structure 11 surrounds secondary combustion zone 34 to efficiently and effectively reduce peak flame temperatures and residence time at the peak flame temperatures to desired levels (see column 4, lines 35–60). In single-zone combustion systems the structure 11 may be disposed within the combustion zone (see column 5, lines 18–29). However, the flame radiator structure should not bend into the combustor flame (see column 7, lines 10–30).

U.S. Pat. No. 2,655,944, to Proehl, dated Oct. 20, 1953, discloses a heating tube for use in a deep fat fryer. As shown in FIGS. 1 and 5, the heating tube may comprise a wire mesh dividing baffle 10. Baffle 10 may be made of Nichrome and it is disposed between burners, parallel to the direction of flow of combustion products in the conduit, so that the burners inject flames into spaces above and below, but not through, the baffle. The baffle is employed to radiate heat from the burners to the sides of the tube (see column 2, lines 25–42). Additional baffles may be disposed downstream of baffle 10 transversely to the direction of flow of combustion gases through the tube, as shown in FIGS. 4 and 5.

U.S. Pat. No. 3,187,798 to Pokorny, dated Jun. 8, 1965, discloses a radiant gas burner comprising a conical refractory shell 30 within which a combustion mixture of fuel and air is burned to heat the shell to incandescence. The shell 30 comprises a plurality of holes 40 through which gaseous combustion products escape.

U.S. Pat. No. 4,044,796, issued Aug. 30, 1977 to Smick, describes a flue gas turbulator which is capable of mixing and directing a heating fluid, such as a flue gas, against the internal walls of a heat exchanger conduit such as a fire tube or the like. The turbulator is stated to be formed of a strip of metal bent into a series of alternating deflection panels successively joined together by bridging sections. The deflection panels along the length of the strip are alternately angling back and forth, thus simultaneously tilting up and down relative to the turbulator axis. The turbulator is particularly shown in the Figures.

U.S. Pat. No. 1,632,888 issued Jun. 21, 1927 to Davis et al is directed to a water heater. As shown in FIG. 1 the water heater comprises a tubular flue 13 through which hot combustion products from burner 14 are passed. The flue is thus heated and in turn heats water in the surrounding storage vessel. Tubular flue 13 contains a heat radiating member 21 that has formed from a strip of suitable sheet material bent into zig-zag form with flat portions directed in various directions. It is stated that the flat portions of the heat radiating member tend to deflect and throw the heat from the burner outward in opposite directions, thus rapidly heating the flue.

SUMMARY OF THE INVENTION

The present invention provides an improvement in the construction and operation of gas-fired furnaces for reducing or eliminating the production of oxides of nitrogen ($NO_x$). Such furnaces conventionally comprise a heat exchanger comprising at least one heat exchange conduit for receiving hot combustion products from a gas burner. The improvement comprises a porous abatement member disposed at the inlet of the conduit, the abatement member comprising a body portion comprising at least one section extending transversely to the direction of flow of the combustion products in the conduit, whereby the combustion products can flow through the porous abatement member, which disperses the heat of combustion, thereby rapidly reducing the temperature of the flue products to abate the formation of oxides of nitrogen.

According to one aspect of the present invention, the abatement member may comprise a body portion having a serpentine configuration establishing a plurality of sections disposed transversely to the direction of flow of the combustion products.

According to another aspect of the present invention, the abatement member may comprise a metallic screen.

According to still another aspect of the present invention, the abatement member may comprise anchor means for securing the abatement member in the conduit.

The present invention also provides a method aspect for abating the formation of oxides of nitrogen in the operation of a gas-fired furnace. The method comprises securing in the flame inlet region of a heat exchange conduit, prior to operating the furnace, an abatement member comprising a porous body portion comprising at least one section disposed transversely to the direction of flow of combustion products into the conduit. The abatement member may be dimensioned and configured as described herein.

DETAILED DESCRIPTION OF THE INVENTION AND CERTAIN PREFERRED EMBODIMENTS THEREOF

The formation of $NO_x$ is known to occur at the high temperatures often attained in the flame regions near the burners in conventional natural gas-fueled furnace combustion systems. In such systems, natural gas is combusted at the outlet of a burner to produce a stream of hot combustion products which are introduced into a heat exchanger conduit in the furnace. The burner is typically positioned so that the combustion flame is directed into the inlet of the heat exchanger conduit, where temperatures can reach 1300° C. or higher, thus fostering the formation of $NO_x$. The present invention is directed toward reducing the formation of $NO_x$ in such systems by quickly dissipating the heat of combustion of the fuel from the flame region. Thus, the regions within the furnace which attain temperatures conducive to the formation of $NO_x$ are substantially reduced.

According to the present invention, a $NO_x$ abatement member is dimensioned and configured to be disposed in the flame inlet region of the heat exchanger conduit. The $NO_x$ abatement member is porous in configuration and has at least one section disposed transversely to the flow direction of the gaseous combustion products. Additional sections may also be disposed transversely to the flow direction, for example, by providing a $NO_x$ abatement member having a serpentine configuration. Since it is porous, the flame and the combustion gases therein pass through the abatement member and the abatement member provides a low, the $NO_x$ abatement member is described as comprising a high surface area on which to absorb heat from the flame region. While in the preferred embodiment described below, the $NO_x$ abatement member is described as comprising a woven metallic screen, it will be understood that the invention may relate more broadly to any porous or perforated refractory member placed in the flame inlet region transversely to the flow of combustion products into the conduit so that the combustion gases in the flame region pass through the abatement member. Preferably, the abatement member extends beyond the flame region in the heat exchanger conduit to a point where heat from the flame region can be dispersed without inducing $NO_x$ formation. The abatement member can thus dissipate the concentrated heat produced in the flame region of the combustion gases, and thus reduce the regions within the fire tube where temperatures are sufficient to cause the production of $NO_x$ pollutants. Preferably, the abatement member is metallic, since metals are good thermal conductors and radiators, but an abatement member according to the present invention may comprise other refractory materials, e.g., ceramic materials, which can withstand exposure to the high temperatures prevailing within the flame in the inlet of the heat exchanger.

Figure 1:
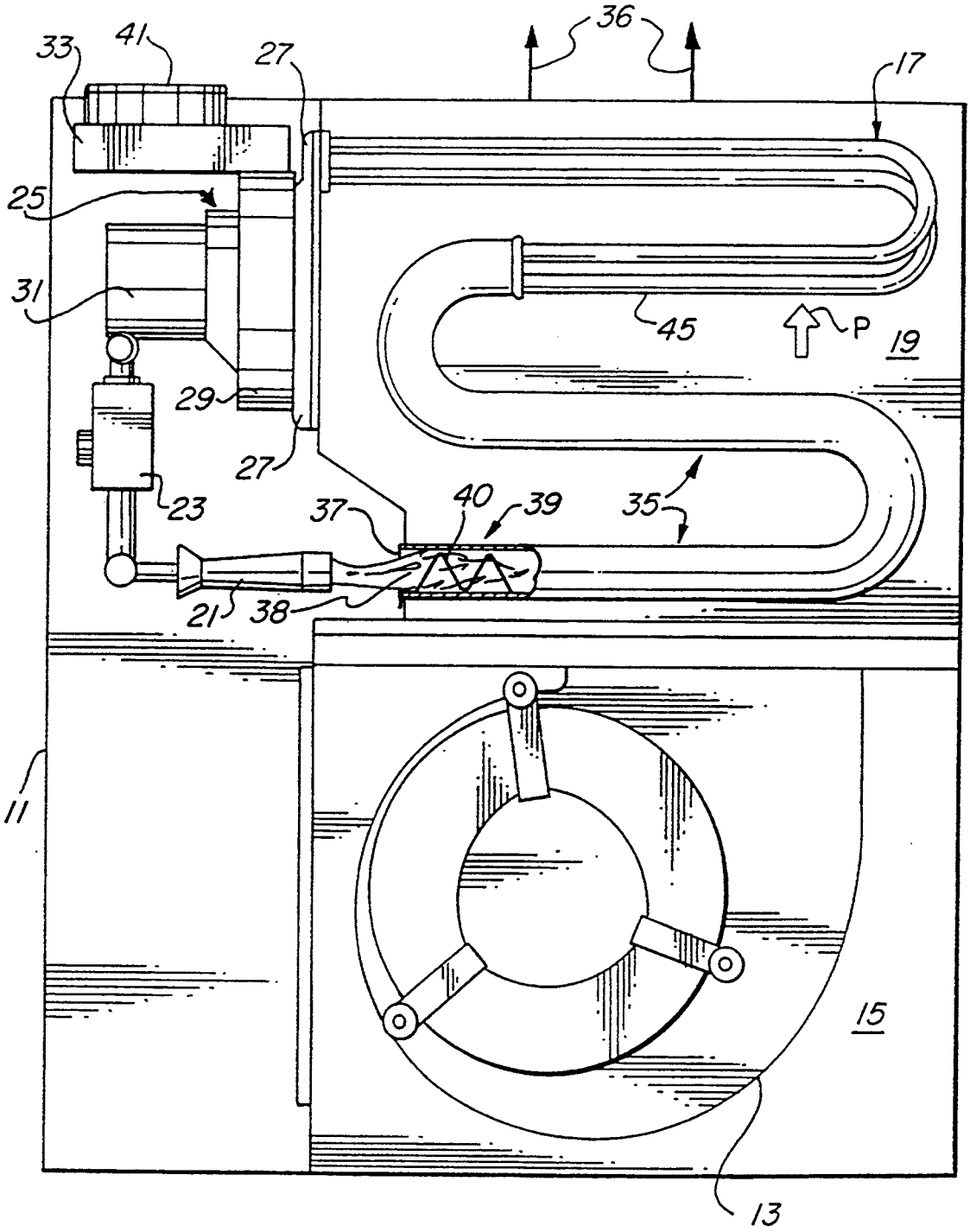
FIG. 1 is a schematic elevational view of a gas-fired furnace combustion system containing a $NO_x$ abatement member according to one embodiment of the present invention.

In the following description, the heat exchanger conduit is provided by a conventional fire tube formed from round steel tubing, but the invention may be used with equal efficacy in other types of heat exchanger conduits, e.g., clamshell heat exchanger conduits, According to one embodiment of the present invention, a gas-fired furnace 11, illustrated in FIG. 1, comprises a $NO_x$ abatement member. Furnace 11 defines a blower chamber 15 within which is disposed a primary blower 13. Chamber 15 communicates with heat exchange chamber 19 within which is disposed a discrete tube-type heat exchanger 17 formed from round steel tubing. Primary blower 13 forces air to be heated in a primary path indicated by outline arrows P through heat exchange chamber 19 where the air is heated through indirect heat exchange by exposure to heat exchanger 17 and is emitted from the furnace as heated air indicated by arrows 36.

Heat exchanger 17 is a tube-type heat exchanger comprising an array of primary fire tubes 35 having inlet ends 37 for the introduction of hot combustion products 38 in flame region 39, which extends into fire tube 35 from burner 21. The operation of burner 21 is controlled in part by gas controller 23. Gaseous combustion products 38 pass from primary fire tubes 35 to a plurality of smaller secondary fire tubes 45 through a conventional transition cap 44. The gaseous combustion products are withdrawn from secondary fire tubes 45 by a draft inducer assembly 25. Inducer assembly 25 comprises a gas collection manifold 27 which mates with the outlet of heat exchanger 17, and an inducer motor 31 to drive an inducer fan disposed within inducer fan housing 29, to draw gaseous combustion products from the heat exchanger outlet. The gaseous combustion products are discharged to an external flue (not shown) by means of discharge chamber 33 which mates to the external flue by means of stack adaptor 41. In accordance with the present invention, each primary fire tube 35 has, at its inlet, a $NO_x$ abatement member such as abatement screen 40 disposed therein. Abatement screen 40 is positioned generally at the beginning of the fire tube 35, in flame region 39, so that the combustion flame passes through the screen. Therefore, abatement screen 40 is positioned in the region where the combustion temperature is at its peak, and can thus most efficiently and effectively reduce peak flame temperatures reached in the fire tube 35, thus reducing the region within the tube which is exposed to these peak flame temperatures. As a result, the formation of $NO_x$, which usually occurs in this region, is reduced or eliminated.

The $NO_x$ abatement screen 40 is formed from a material which is able to withstand the high combustion flame temperatures generated without being damaged by oxidizing, cracking, etc. In this regard, it has been found that a screen made out of materials such as high temperature stainless steels and ceramics. A particularly preferred screen is formed from KANTHAL D, which is a ferritic iron-chromium-aluminum alloy.

The $NO_x$ abatement screen 40 quenches the combustion flame produced by burner 21 by absorbing thermal energy from the combustion flame and dispersing the energy within fire tube 35. This, in turn, helps limit peak flame temperatures and residence times, which inhibit the formation of $NO_x$ while allowing substantial complete combustion of the fuel supplied to the burner 21.

Figure 2:
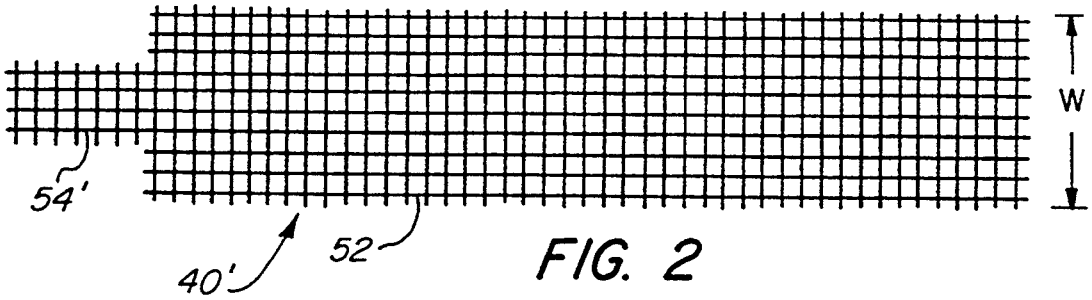
FIG. 2 is a schematic plan view of a screen mesh used to form a $NO_x$ abatemetn member according to the present invention.
Figure 3:
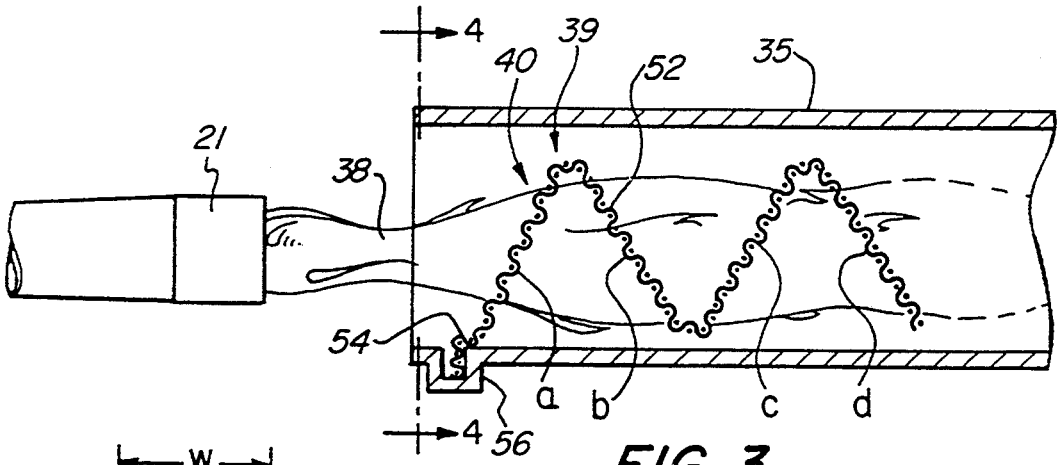
FIG. 3 is an enlarged view of the burner fire tube inlet and $NO_x$ abatement member shown in FIG. 1.
Figure 4:
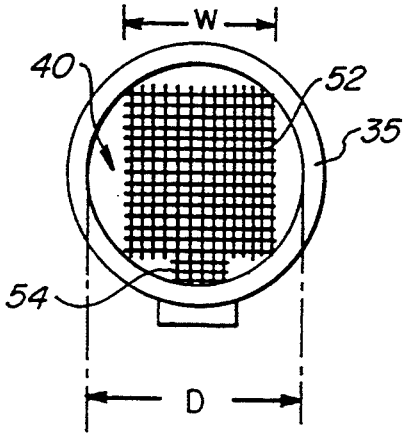
FIG. 4 is a cross-sectional view of the fire tube of FIG. 3 taken at line 4—4 and viewed in the direction of the arrows.

A $NO_x$ abatement screen according to the present invention may be produced from a mesh blank 40', shown in FIG. 2, which may be stamped from a wire mesh sheet. Blank 40' comprises a generally rectangular body portion 52 and a detent portion 54' extending axially from one end of body portion 52. The width W of body portion 52 is less than the inner diameter D of the primary fire tube 35 (FIG. 4) so that body portion 52 can be disposed in a configuration in which it has at least one segment which extends transversely to the direction of flow of combustion products in the flame region in fire tube 35. A serpentine configuration as seen in FIG. 3 is easily achieved and is preferred because of the multiple transverse section a, b, c and d that are provided by body portion 52. So formed, the abatement screen 40 is placed within primary fire tube 35 as shown in FIG. 3. So disposed, segments a, b, c and d of body portion 52 extend transversely to the flow of hot combustion products in the flame region 39 produced by burner 21 and the inner circular sections of these segments which lie within the cylindrical-shaped flame region conduct heat to the outer sections of the segments a, b, c and d. The entirety of abatement screen 40 disperses heat to fire tube 35 as radiant energy, and the outer sections of the segments a, b, c and d, which lie outside flame region 39, disperses heat by convection to the secondary combustion air surrounding flame region 39. As seen in the cross-sectional view of FIG. 4, abatement screen 40 extends transversely to at least a substantial portion of the cross-sectional flow area of tube 35.

Figure 5:
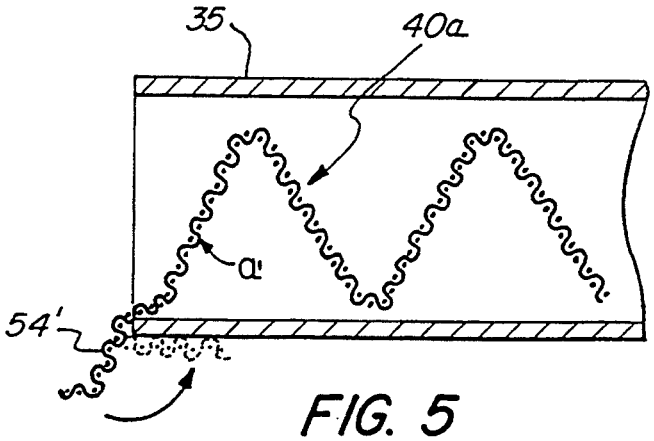
FIG. 5 is a view similar to that of FIG. 3 of a $NO_x$ abatement member according to another embodiment of the present invention.

To secure $NO_x$ abatement screen 40 within tube 35, the interior of tube 35 may be equipped with a closed-ended slot 56 within which detent 54 of abatement screen 40 may be received. In an alternative embodiment, an abatement screen **40*a* may comprise anchor means such as a clip 54' (FIG. 5) resembling detent 54 except that it is longer and may be dimensioned and configured to be crimped or bent over the inlet of tube 35 to secure screen 40*a*** therein.

While the invention has been described in detail with respect to specific preferred embodiments thereof, it will be appreciated by those skilled in the art that, upon a reading and understanding of the foregoing, numerous variations may be made to the disclosed embodiments which variations are nonetheless believed to lie within the spirit and scope of the invention and of the appended claims.

What is claimed is:

1. In a gas-fired furnace comprising a heat exchanger comprising at least one heat exchange conduit having a flame inlet region for receiving a combustion flame and hot combustion products from a gas burner, the improvement comprising a porous abatement member disposed in the flame inlet region of the conduit, the abatement member comprising a body portion having a serpentine configuration establishing a plurality of sections disposed transversely to the direction of flow of the combustion products in the conduit, whereby the combustion flame and combustion products therein pass through the abatement member, for abating the formation of oxides of nitrogen.

2. The furnace of claim 1 wherein the abatement member comprises a metallic screen.

3. The furnace of claim 1 or claim 2 wherein the abatement member comprises anchor means for securing the abatement member in the conduit.

4. A method for abating the formation of oxides of nitrogen in the operation of a gas-fired furnace which generates a combustion flame, wherein the furnace comprises a heat exchange conduit into which the combustion flame and hot combustion products therein are directed, the heat exchange conduit having a flame inlet region in which is disposed a porous abatement member comprising a body portion having a serpentine configuration establishing a plurality of sections disposed transversely to the direction of flow of combustion products into the conduit, the method comprising passing the combustion flame and combustion products therein through the abatement member to abate the formation of NOx.

5. The method of claim 1 wherein the abatement member further comprises a clip of the abatement member disposed over the inlet of the conduit.

6. The method of claim 1 wherein the abatement member further comprises a detent of the abatement member disposed in a slot in the conduit.

* * * * *

UNITED STATES PATENT AND TRADEMARK OFFICE

CERTIFICATE OF CORRECTION

PATENT NO. : 5,333,597

DATED : August 2, 1994

INVENTOR(S) : Michael E. Kirkpatrick et al

It is certified that error appears in the above-indentified patent and that said Letters Patent is hereby corrected as shown below:

In column 1, line 10, replace "amd" with --and--.

In column 3, line 26, replace "abatemetn" with --abatement--.

In column 3, lines 67-68, delete "low, the $NO_x$ abatement member is described as comprising a"

In claim 5, replace "claim 1" with --claim 4--.

In claim 6, replace "claim 1" with --claim 4--.

Signed and Sealed this

Third Day of October, 1995

*Attest:*

BRUCE LEHMAN

*Attesting Officer*

*Commissioner of Patents and Trademarks*